US006220924B1

(12) United States Patent
Kobayashi et al.

(10) Patent No.: US 6,220,924 B1
(45) Date of Patent: Apr. 24, 2001

(54) BRASSIERE

(75) Inventors: Mitsue Kobayashi, Ueda; Hitomi Kato, Tokyo, both of (JP)

(73) Assignee: Bright Eyes Co., Ltd., Nagano (JP)

( * ) Notice: Subject to any disclaimer, the term of this patent is extended or adjusted under 35 U.S.C. 154(b) by 0 days.

(21) Appl. No.: 09/492,319

(22) Filed: Jan. 27, 2000

(30) Foreign Application Priority Data

Apr. 22, 1998 (JP) ..... 10-112421
Jan. 27, 1999 (JP) ..... 11-017817

(51) Int. Cl.[7] ..... A41C 3/00
(52) U.S. Cl. ..... 450/9; 450/1
(58) Field of Search ..... 450/1, 2, 7, 8, 450/9, 10, 11, 12, 23, 41, 47, 48, 51, 52, 53, 54, 55, 56, 57, 60–64

(56) References Cited

U.S. PATENT DOCUMENTS 2,706,816 * 4/1955 Dozier ..... 450/1
2,753,563 * 7/1956 Blitch ..... 450/1
3,094,125 * 6/1963 Lewis ..... 450/1
3,465,754 * 9/1969 Lockwood et al. ..... 450/1
3,949,760 * 4/1976 Baranowski et al. ..... 450/1
4,185,332 * 1/1980 Jahnig ..... 623/7
5,697,830 * 12/1997 White ..... 450/36
6,089,954 * 7/2000 Grewe ..... 450/1

FOREIGN PATENT DOCUMENTS 4980594 10/1972 (JP) .
58-110006 7/1983 (JP) .
60-86342 6/1985 (JP) .
330208 3/1991 (JP) .
358410 6/1991 (JP) .
9296308 11/1997 (JP) .

* cited by examiner

*Primary Examiner*—Gloria Hale
(74) *Attorney, Agent, or Firm*—Birch, Stewart, Kolasch & Birch, LLP

(57) ABSTRACT

A right-left separation type brassiere for protecting and shaping right and left breasts separately, comprises: a cup portion 11 for protecting and shaping one of the breasts; band portion 12 being connected to a lower portion of the cup portion 11 and adapted to attach the cup portion by being passed around a chest once; and a shoulder strap 13 being attached at one end thereof to an upper portion of the cup portion and at the other end thereof to the band portion at a back after passed over a shoulder. A supplementary pad for supplementing a swelling of the breast is provided to the cup portion.

8 Claims, 5 Drawing Sheets

BRASSIERE

FIELD OF TECHNOLOGY

The present invention relates to a brassiere, which is under wear for a woman.

BACKGROUND TECHNOLOGY

Brassieres have been used as under wear for women, and they are variously designed with functions and made of many kinds of materials. some purposes of brassieres are shaping a figure for a body and supporting breasts to easily move, Further they are used by women, whose breasts have been surgically removed due to breast cancer or mastitis, to shape their body figures.

In the case of using the brassiere to shape a body figure of the woman who lost a breast, a supplementary pad for supplementing the lost breast is attached into a cup portion corresponding to the lost breast so as to remake swelling of the breast. In most cases operation for breast cancer or mastitis, one of the breasts is surgically removed; removing both breasts is rare. Thus, in an ordinary brassiere, one of the cup portions is filled with the supplementary pad. The brassiere with the supplementary pad is capable of shaping the body figure and being used as well as the brassiere for a healthy woman.

Besides the cup portion filled with the supplementary pad, the brassiere also has a pair of cup portions, a band portion for supporting the cup portions, shoulder straps and hook members. As described above, the brassiere is capable of remaking the swelling of the lost breast, but it has the following disadvantages.

By wearing the conventional brassiere with the supplementary pad, the body figure can be shaped and the operated chest can be protected, but the functions are lost when a women takes off the brassiere. While wearing the brassiere, the chest of the user is compressed and she feels tight and hotter, so it is hard for the user to wear the brassiere for a long time. These disadvantages are not only for the woman operated but also for a healthy woman; especially, for the woman operated, when she takes off the brassiere, the operated chest is not protected she feels uneasy, and the shape of the chest is unbalance with home wear.

The conventional brassieres with the supplementary pads have been designed so as to shape body figures of users without considering said disadvantages, which will occur when the users take off the brassieres. Even a woman who has been operated on feels better when she takes off the brassiere from the normal breast. The woman operated upon does not want to show her operated chest to others, but she wants to take off the brassiere for the normal breast to relax. However, the conventional brassieres cannot meet the requirements and cannot be used easily.

The present invention has been invented to solve the disadvantages of the conventional brassieres, which includes the supplementary pads, so an object of the present invention is to provide a brassiere, which is capable of shaping a figure of a lost breast when a women wears home wear, and being easily used without discomfort.

DISCLOSURE OF THE INVENTION

The present invention is a right-left separation type brassiere for protecting and shaping right and left breasts separately, comprises: a cup portion for protecting and shaping one of the breasts; a band portion being connected to a lower portion of the cup portion and adapted to attach the cup portion by being passed around a chest; and a shoulder strap being attached at one end thereof to an upper portion of the cup portion and at the other end thereof to the band portion at a back being passed over a shoulder.

The brassiere is the right-left separation type, so the right and left brassieres can be selectively taken off. For the woman who has had a breast removed, only one brassiere corresponding to the normal breast can be taken off, and the other brassiere can be used, so that the normal breast can be released and the user can relax.

The brassiere may further comprise a pocket portion being provided to the cup portion, and the pocket portion may be capable of accommodating a supplementary pad; with this structure, the proper supplementary pad can be easily attached into the pocket portion.

In the brassiere, the supplementary pad may be attached in the pocket portion, which is provided to the cup portion.

In the brassiere, the cup portion, the band portion and the shoulder strap may be integrally formed as one piece; with this structure, the brassiere can be fitted to a proper position without shift.

The brassiere may further comprise connecting means being respectively provided to both ends of the band portion and being located on a chest side; with this structure the ends of the band portion can be easily connected and disconnected on the chest side.

In the brassiere, the band portion may be disconnected at a portion shifted to the other breast; with this structure, the brassiere can be fitted at a proper position without shift.

In the brassiere, the other end of the shoulder strap may be attached at a part of the band portion, which is shifted to the other breast; with this structure, the shoulder straps cross on the back side and the brassieres can be securely fitted when the user wear the right and left brassieres.

The present invention is also a set of brassieres comprising a right brassiere and a left brassier, each of which has been described above, wherein the band portions of the brassieres are piled on the chest side; with this structure, the right and left brassieres can be properly fitted at proper positions without shift.

EMBODIMENTS

Preferred embodiments of the present invention will now be described in detail with reference to the accompanying drawings.

Figure 1:
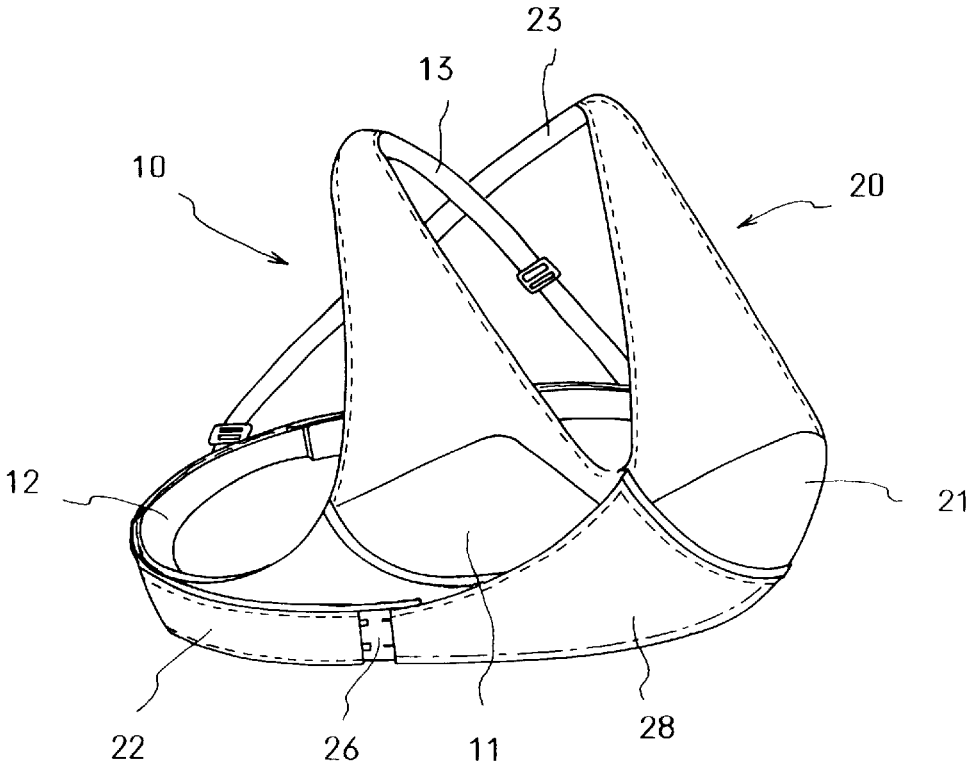
FIG. 1 is a perspective view of a state of wearing a brassiere.

FIG. 1 is a perspective view of an embodiment of the brassiere of the present invention. The brassiere is a right-left separation type including a pair of brassieres 10 and 20. The brassiere 10 supplements swelling of a right breast, which has been surgically removed; the brassiere 20 supports a left breast. In the present embodiment, the brassiere for a woman, whose right breast was surgically removed, will be explained, but the brassiere for a woman, whose left breast was surgically removed, is basically same.

The brassiere of the present invention is the right-left separation type including the brassieres 10 and 20, so the brassieres 10 and 20 are put on separately, and a combination of the brassieres 10 and 20 can be used as well as the ordinary brassieres.

Figure 2:
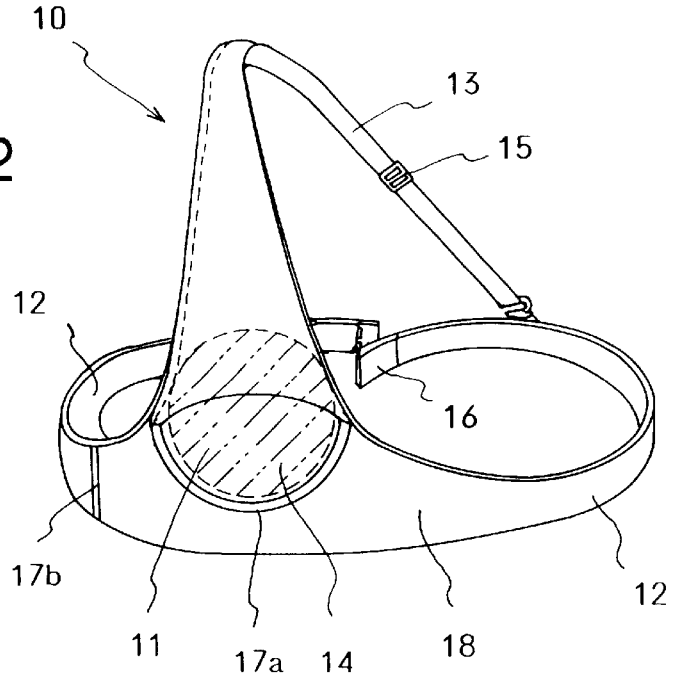
FIG. 2 is a perspective view of a right brassiere.
Figure 3:
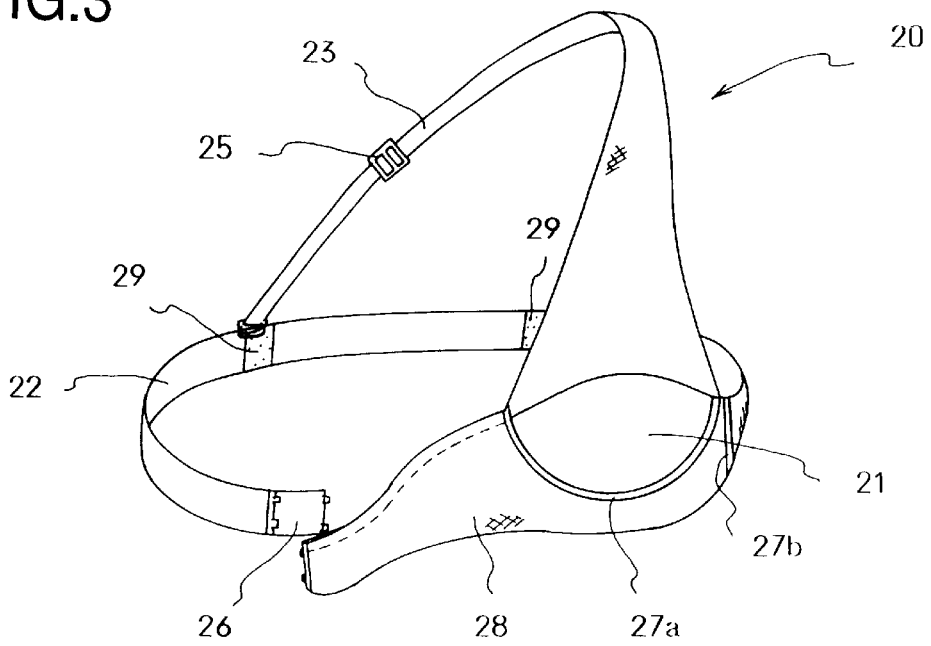
FIG. 3 is a perspective view of a left brassiere.

FIGS. 2 and 3 show the structures of the brassieres 10 and 20. FIG. 2 is a perspective view of the right brassiere 10; FIG. 3 is a perspective view of the left brassiere 20.

The right brassiere 10 comprises: a cup portion 11 for protecting and shaping the right breast which has been removed, a band portion 12 being connected to a lower portion of the cup portion 11 and adapted to attach the cup portion by being passed around a chest; and a shoulder strap 13 being attached at one end thereof to an upper portion of the cup portion 11 and at the other end thereof to the band portion 12 at a back portion after being passed over a shoulder. The left brassiere 20 also comprises: a cup portion 21; a band portion 22; and a shoulder strap 23. The band portions 12 and 22 are wholly or partially made of an elastic material, and they are capable of respectively supporting the cup portions 11 and 21 at the chest.

The right brassiere 10 has a supplementary pad 14, which is accommodated in the cup portion 11, so as to supplement the swelling of the right breast. The supplementary pad of the present specification is used for supplementing the swelling of the breast which has been surgically removed, so it is different from an ordinary pad for shaping the figure of a normal breast. The supplementary pad 14 is made of a soft and fittable material, e.g., silicone rubber, so as to be easily and stably used. Further, the supplementary pad should feel soft and have proper air-permeability. A shape and size of the supplementary pad 14 are designed on the basis of the user's options.

As described in FIGS. 2 and 3, the cup portions 11 and 21 of the brassieres 10 and 20 are located to correspond with the breasts; the shoulder straps 13 and 23 of the brassieres 10 and 20 are designed to cross on the back when the brassieres are put on. Namely, in the brassiere 10, the cup portion 11 is located on the right side, and the other end of the shoulder strap 13 is attached to a part of the band portion 12, which is located on the opposite side with respect to the cup portion 11.

On the other hand, in the brassiere 20, the cup portion 21 is located on the left side, and the other end of the shoulder strap 23 is attached to a part of the band portion 22, which is located on the opposite side with respect to the cup portion 22.

By attaching the other ends of the shoulder straps 13 and 23 are respectively attached to the parts of the band portions 12 and 22, which are respectively located on the opposite sides with respect to the cup portions 11 and 21, each of the brassieres 10 and 20 can be securely fitted. The elasticity of the band portions 12 and 22 respectively hold the cup portions 11 and 21 at the chest, further the cup portions 11 and 12 can be securely fitted to the breasts by the band portion 12 and 22 and the shoulder straps 13 and 23. Note that, length of the shoulder straps 13 and 23 can be adjusted by adjusters 15 and 25.

The brassieres 10 and 20 can be worn separately, but in the case of wearing the both brassieres, firstly the right brassiere 10 for the operated breast is worn, then the left brassiere 20 is worn. With this manner, the user can wear the right brassiere 10 even if the left brassiere 20 is taken off.

As shown in FIG. 2, connecting means, e.g., a hook section 16, is provided to both ends of the band portion 12 of the brassiere 10, and the hook section 16 is located on the back side, so that the ends of the band portion 12 can be connected and disconnected. When the user wears the brassiere 10, firstly the shoulder strap 13 is passed over the shoulder, then the cup portion 11 is adjusted to locate at a proper position, and the ends of the band portion 12 are connected by the hook section 16. A symbol 17*a* stands for a wire for maintaining the shape of the cup portion 11; a symbol 17*b* stands for a wire for maintaining the shape of the side of the band portion 12. A symbol 18 stands for a front portion of the band portion 12, the front portion 18 is made wider and diagonally connected to a mid portion of the band portion because the brassieres 10 and 20 are piled on the chest when the brassieres 10 and 20 are worn.

As shown in FIG. 3, in the left brassiere 20, connecting means, e.g., a hook section 26, is provided to both ends of the band portion 22, and the hook section 26 is located on the front side, so that the ends of the band portion can be connected and disconnected. When the brassiere 20 is worn, the hook section 26 is located under the cup portion of the brassiere 10 and slightly shifted rightward. By slightly shifting the hook section 26, the right brassiere 10 is pressed by the left brassiere 20 so as to securely fit the brassieres when the left brassiere 20 is worn.

When the user wears the brassiere 20, firstly the shoulder strap 23 is passed over the shoulder, then the cup portion 21 is adjusted to locate at a proper position, and the ends of the band portion 22 are connected by the hook section 26. FIG. 1 shows the state of wearing the brassieres 10 and 20, in which a front portion 28 is crossed and piled on the lower brassiere 10, and the shoulder straps 12 and 13 are crossed on the back.

When the left brassiere 20 is worn, the band portion 22 is piled on the band portion 12 of the right brassiere 10, so the band portions 12 and 22 are mutually connected, by plane fasteners, on the backside. In FIG. 3, the plane fasteners 29 are provided on an inner face of the band portion 22. Two plane fasteners 29, which are respectively correspond to the shoulder straps 13 and 23, are provided to each of the band portions 12 and 22. In the right brassiere 10, a fastener capable of being connected with the plane fastener 29 is provided on an outer face of the band portion 12. By the fasteners, the band portions 12 and 22 of the combined brassieres 10 and 20 will never shift on the back.

Figure 4:
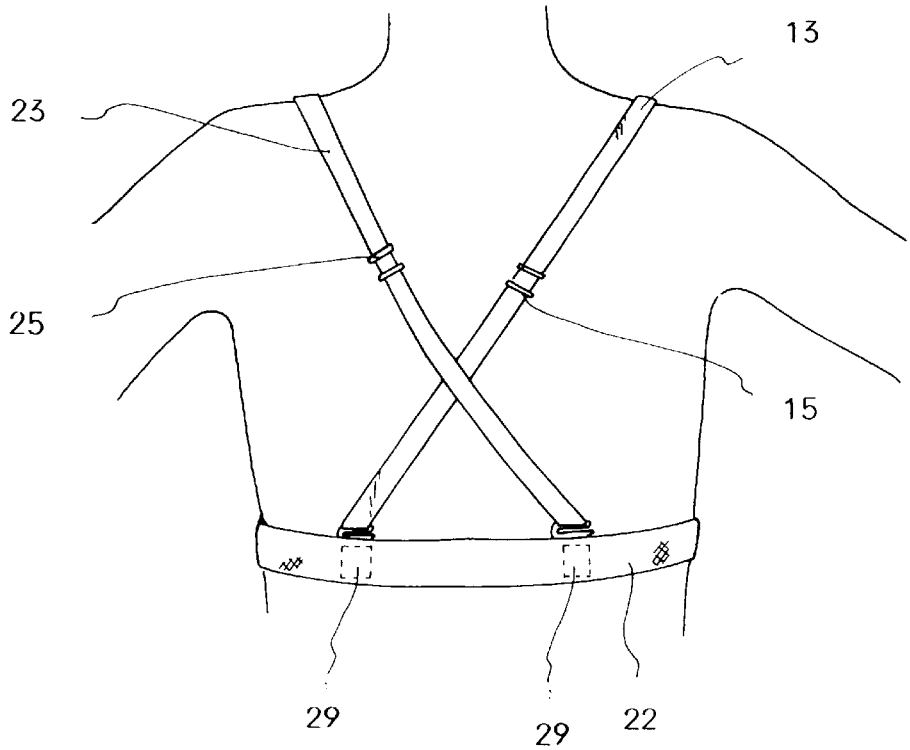
FIG. 4 is an explanation view of a state wearing the right and left brassieres seen from a back.

FIG. 4 is a state of wearing the brassieres seen from the backside. The shoulder straps of the right and left brassieres 10 and 20 are crossed on the back and respectively attached to the band portions 12 and 22; the band portion 22 is provided on the outer side of the band portion 12; the band portion 22 is connected with the band portion 12 by the plane fastener 29. By the arrangement of the band portions 12 and 22 and the shoulder straps 13 and 23, the brassieres 10 and 20 can be securely fitted.

By wearing the right and left brassieres 10 and 20, the combined shape of them is similar to a shape of an ordinary brassiere. The supplementary pad 14 is attached in the cup portion 11 of the right brassiere 10, so the operated breast can be shaped and the figure of the user can be made better. By crossing the left brassiere 20 over the right brassiere 10, the right cup portion 11, in which the supplementary pad is provided, can be held at the proper position without shift.

The right cup portion 11, in which the supplementary pad is provided, is apt to shift, but it can be held at the proper position by crossing the brassieres.

Figure 5:
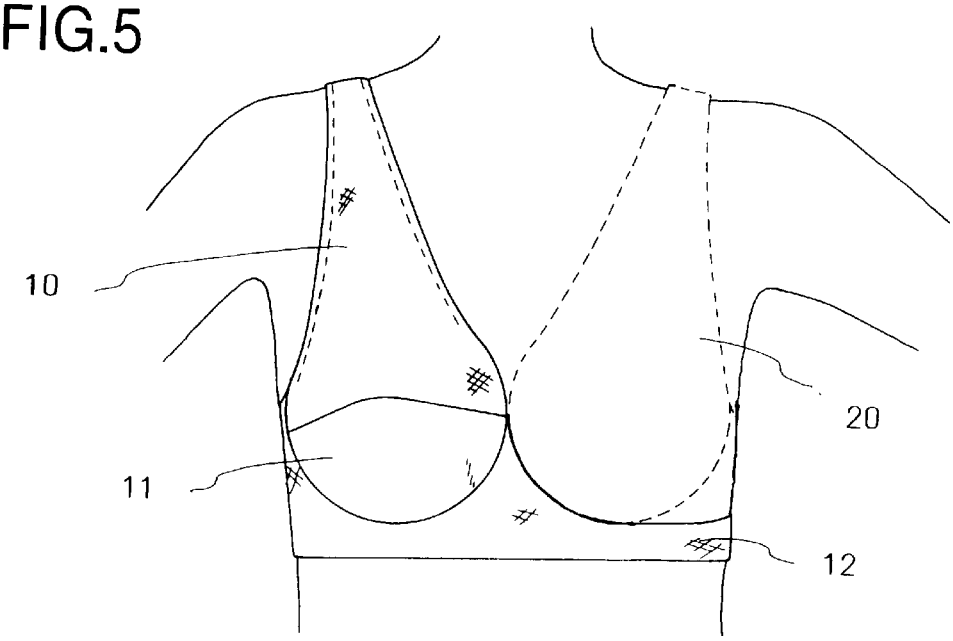
FIG. 5 is an explanation view of a state taking off the left brassiere.

FIG. 5 shows a state in which the right brassiere 10 is worn but the left brassiere 20 is not worn. The brassieres 10 and 20 can be used separately, so the user can take off the left brassiere 20 and wear the right brassiere 10 when she relaxes with home wear. By wearing the right brassiere 10 only, the left breast is released from the brassiere, so that she can relax. Especially, the left breast can be cooled in summer.

By wearing the right brassiere 10, the figure of the body can be well balanced, so she can wear any clothes without minding her figure. And, by wearing the right brassiere 10, the operated breast is covered and protected, so she can take off clothes with a sense of relief.

Figure 6:
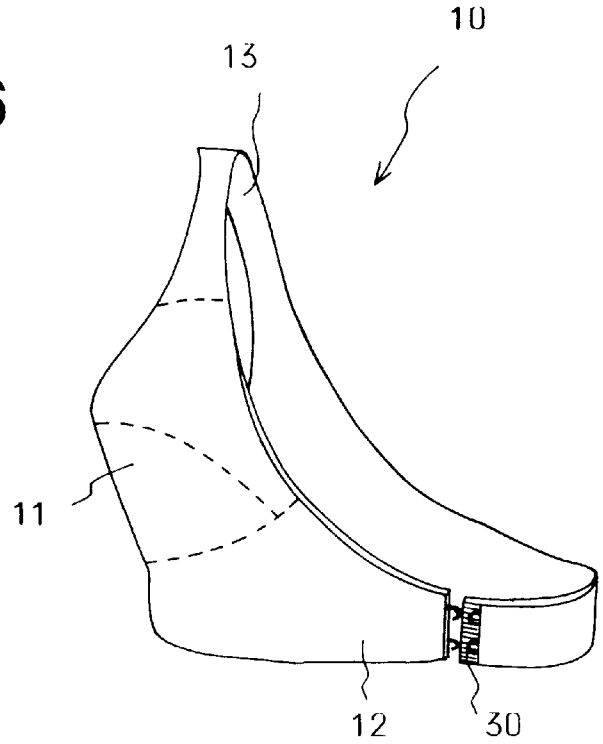
FIG. 6 is a perspective view of another right brassiere.
Figure 7:
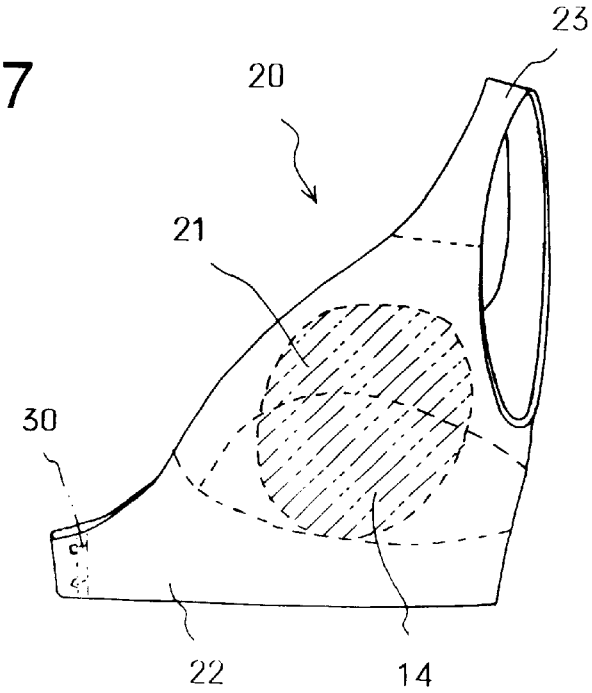
FIG. 7 is a perspective view of another left brassiere.

Another embodiment of the brassiere of the present invention will be explained with reference to FIGS. 6–9. Unlike the former embodiment, the right brassiere 10 is used for the normal breast; the left brassiere 20 is used for the operated breast. The brassieres 10 and 20 are separately worn and overlapped, and the supplementary pad 14 is attached to the left brassiere 20 as well as the former embodiment. As shown in FIGS. 6 and 7, a feature of the present embodiment is that the cup portion 11 or 21, the band portion 12 or 22 which is passed around the chest, and the shoulder strap 13 or 23 are integrally formed as one piece.

In the left brassiere 20, the cup portion 21, the band portion 22 and the shoulder strap 23 are integrally connected, so a head and an arm are passed through the brassiere to wear. On the other hand, in the right brassiere 10, there is provided connecting means, e.g., a hook section 30, at a mid portion of the band portion 12, so ends of the band portion can be disconnected. A hook mechanism and a plane fastener may be employed as the hook section 30.

Figure 8:
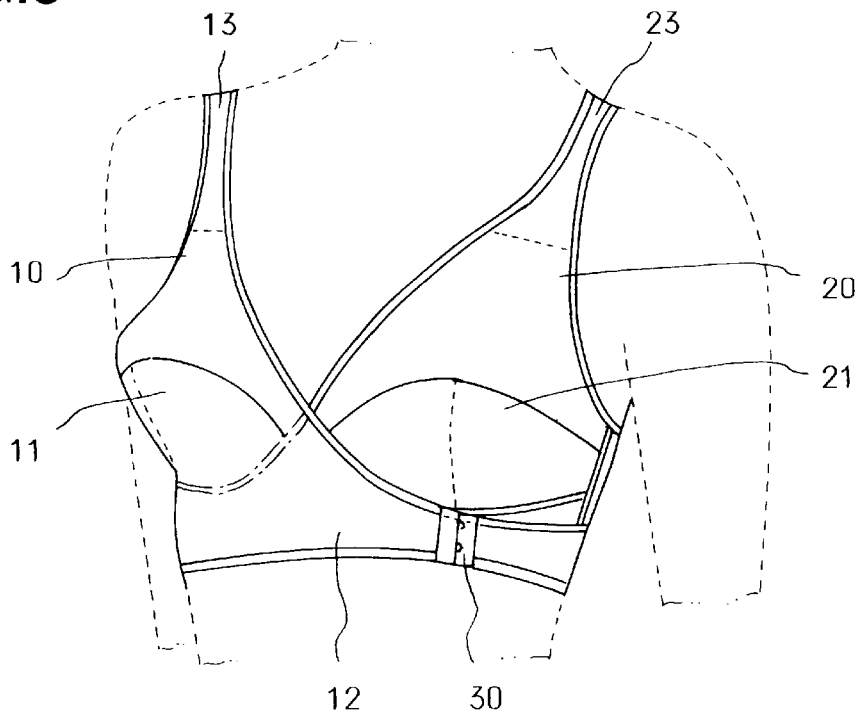
FIG. 8 is a perspective view of a state wearing the right and left brassieres.
Figure 9:
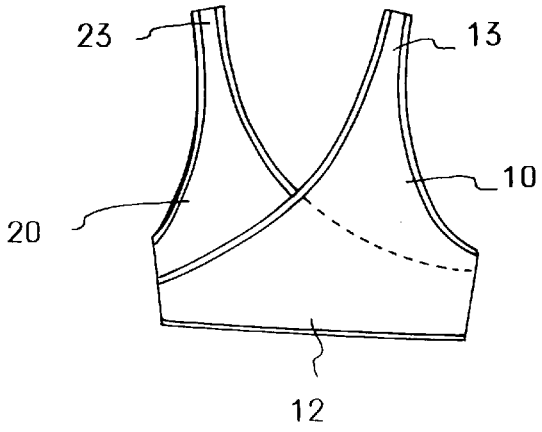
FIG. 9 is an explanation view of a state wearing the right and left brassieres seen from a back.

FIG. 8 is a perspective view showing a state of the brassieres 10 and 20 of the present embodiment. The right brassiere 10 for the normal breast is piled over the other one as well as the former embodiment. Further, the front portions of the brassieres 10 and 20 are overlapped, and the hook section 30 is shifted leftward to securely hold the left brassiere 20 as well as the former embodiment.

In the present embodiment, the cup portion 11 or 21, the band portion 12 or 22 and the shoulder strap 13 or 23 are integrally formed as one piece, so the brassieres are made of the elastic cloth to easily wear and to securely hold at the proper positions without shift. Especially, the brassiere having the supplementary and the brassiere having the supplementary pad 14 is not taken off frequently. Note that, in some cases, the band portion 22 of the left brassiere 20 may have the hook section 30 to disconnect. If the both band portions 12 and 22 have the hook sections 30, the user, whose both breasts are surgically removed, can use the brassieres because the supplementary pads 14 can be attached to the both cup portions. Further, the right brassiere 10 too may be integrally formed as one piece.

In the case of attaching the supplementary pad 14 to the cup portion 11 or 21, the supplementary pad 14 may be previously fixed to the cup portion, or the user may attach the supplementary pad 14 to the cup portion 11 or 21 when she uses the brassiere. Each user has their own size cup portion, so a pocket portion or portions may be formed in the cup portion 11 and/or 21, into which the supplementary pad or pads 14 are inserted. If size of the pocket portion is relatively large, the supplementary pads having various sizes can be employed.

In the above-described embodiments, the right-left separation type brassiere has been explained, further the user may wear the brassiere with the supplementary pad 14 and the ordinary brassiere. In this case, the ordinary brassiere covers the lower brassiere, which includes the supplementary pad 14, and the normal breast, and the lower brassiere makes a good breast figure. With the ordinary brassiere, the user can choose favorite brassieres.

In the above-described embodiments, the brassiere for the user, whose one of breasts was surgically removed, has been explained, but the brassiere of the present invention can be used by a user whose both breasts were surgically removed. In this case, the supplementary pads 14 are respectively attached to the cup portions of the right and left brassieres 10 and 20. Each of the brassieres may be integrally formed as one piece and may have the hook section 30 in the band portion.

Further, the brassiere of the present invention can be effectively used by a healthy user having both breasts. A woman takes off the ordinary brassiere when she nurses; if she wears the brassieres of the present invention, she may take off one of the brassieres only, so the brassiere of the present invention can be effective for nursing women. In the case that the healthy user uses the brassieres, no supplementary pad 14 is attached to the cup portions 11 and 21 of the brassieres 10 and 20. Jastead only the ordinary pads and the wires, which maintain the figure of the breasts, are required. And, the connecting means may be provided in the front portions of the band portions of the right and left brassieres 10 and 20 so as to easily wear. The brassiere can be used for many purposes other than for nursing.

The preferred embodiments of the present invention have been described. As described above, the wires 17*a* and 27*a*, which maintain the shape of the brassiere, may be employed, and an elastic material, e.g., rubber, may be partially used in the hook sections 16 and 26. A material of the brassiere may be selected on the basis of the air-permeability, softness, moisture absorbility, etc., and lace cloth may be used. Shapes and sizes of the cup portions 11 and 21, connecting positions of the shoulder straps 13 and 23, designs, etc. may be optionally changed.

What is claimed is:

1. A right-left separation type brassiere for protecting and shaping a pair of breasts of a person separately, wherein said pair of breasts include a breast that has been surgically operated upon and a relatively normal breast, comprising:

a first cup portion for protecting and shaping said breast that has been surgically operated upon;

a first band portion being connected to a lower portion of said first cup portion and adapted to attach said first cup by being passed around a chest of said person;

a first shoulder strap being attached at one end thereof to an upper portion of said first cup portion and at an other end thereof to the first band portion at a back portion after being passed over a shoulder of said person;

a second cup portion for supporting the other normal breast;

a second band portion being connected to a lower portion of said second cup portion and adapted to attach said second cup by being passed around the chest of said person, and having a first end and a second end;

a second shoulder strap being attached at one end thereof to an upper portion of said second cup portion and at an other end thereof to the second band portion at a back portion after being passed over an opposite shoulder of said person; and connecting means being respectively provided to each end of said second band portion and being located on a chest side of said second band portion, whereby the ends of said second band portion can be connected and disconnected at a position under said first cup portion, wherein said first cup portion is provided in a position interior to said second cup portion.

2. The brassiere according to claim 1, wherein an inner hem of said first cup portion and an inner hem of said second cup portion are mutually crossed on the chest.

3. The brassiere according to claim 1, further comprising a pocket portion being provided for said first cup portion, said pocket portion being capable of accommodating a supplementary pad for simulating a healthy breast.

4. The brassiere according to claim 3, wherein the supplementary pad is attached in said pocket portion.

5. The brassiere according to claim 1, wherein said first cup portion, said first band portion, and said first shoulder strap are integrally formed as a single piece.

6. The brassiere according to claim 3, wherein said first cup portion, said first band portion, and said first shoulder strap are integrally formed as a single piece.

7. The brassiere according to claim 1, wherein the other end of said first shoulder strap is attached at a part of said first band portion located opposite to said second cup portion, and the other end of said second shoulder strap is attached at a part of said second band portion located opposite to said first cup portion.

8. The brassiere according to claim 1, wherein said first band portion and said second band portion are piled on the chest side.

* * * * *